US009592995B2

(12) United States Patent
Fierri

(10) Patent No.: US 9,592,995 B2
(45) Date of Patent: Mar. 14, 2017

(54) UNLOCKING CONTROL FOR A LIFT FLOOR DOOR

(71) Applicant: Gabriel Fierri, Arcegno (CH)

(72) Inventor: Gabriel Fierri, Arcegno (CH)

(73) Assignee: Kone Corporation, Helsinki (FI)

( * ) Notice: Subject to any disclaimer, the term of this patent is extended or adjusted under 35 U.S.C. 154(b) by 727 days.

(21) Appl. No.: 13/938,576

(22) Filed: Jul. 10, 2013

(65) Prior Publication Data

US 2013/0292212 A1 Nov. 7, 2013

Related U.S. Application Data

(63) Continuation of application No. PCT/EP2011/053190, filed on Mar. 3, 2011.

(51) Int. Cl.
*B66B 13/20* (2006.01)
*B66B 5/00* (2006.01)

(52) U.S. Cl.
CPC ..... *B66B 5/00* (2013.01); *B66B 13/20* (2013.01)

(58) Field of Classification Search
CPC ..... B66B 13/18; B66B 13/20; B66B 13/185; B66B 5/00; B66B 5/0031
USPC ..... 187/249, 401
See application file for complete search history.

(56) References Cited

U.S. PATENT DOCUMENTS 997,848 A 7/1911 Randall
1,129,537 A 2/1915 Bataille
1,352,304 A 9/1920 Montelius
1,692,187 A 11/1928 Rice
1,765,526 A * 6/1930 Glaser ..... B66B 13/20 187/280
2,307,542 A 1/1943 Prince
2,428,063 A * 9/1947 Bleyle ..... B66B 13/20 200/61.65
4,934,488 A * 6/1990 Umemura ..... B66B 13/16 187/335
5,544,720 A 8/1996 Spiess
6,591,946 B2 7/2003 Lauch

FOREIGN PATENT DOCUMENTS

JP 04045093 A * 2/1992 ..... B66B 11/0226
JP 2003-335483 A 11/2003
JP EP 2263963 A1 * 12/2010 ..... B66B 13/18

OTHER PUBLICATIONS

Chinese Office Action issued Jul. 3, 2014 for CN Application No. 201180068936.2.
International Search Report PCT/ISA/210 for PCT/EP2011/053190 dated Nov. 21, 2011.
Written Opinion PCT/ISA/237 for PCT/EP2011/053190 dated Nov. 21, 2011.

* cited by examiner

*Primary Examiner* — William A Rivera
*Assistant Examiner* — Stefan Kruer
(74) *Attorney, Agent, or Firm* — Harness, Dickey & Pierce, P.L.C.

(57) ABSTRACT

Control system for disengaging a safety lock of a lift floor door, comprising: a linear actuation unit; at least one plate in elastically deformable material; at least one actuation cable between said actuation unit and said plate; said actuation unit, said plate and said actuation cable being associated with the lift cabin, in which the actuation cable induces a deformed configuration of said plate, and the plate in deformed configuration disengages said safety lock so as to allow the floor door to open.

15 Claims, 6 Drawing Sheets

UNLOCKING CONTROL FOR A LIFT FLOOR DOOR

This application is a continuation of PCT International Application No. PCT/EP2011/053190 which has an International filing date of Mar. 3, 2011, the entire contents of which are incorporated herein by reference.

FIELD OF THE INVENTION

The present invention concerns an unlocking control for a lift door. In particular the invention concerns an improvement to known control systems using a retractable sliding shoe for disengaging a safety lock that prevents opening of the floor door in absence of the cabin.

PRIOR ART

Lifts need a system that enables the floor doors to open only when the cabin is present, for obvious safety reasons. For this purpose it is known to equip the floor door with a safety system, for example a mechanical bolt lock, which prevents the floor doors from opening, except for when the cabin is present. For this purpose the cabin must be able to disengage the lock when it is present. In a known and widely used type of lift, the cabin is equipped with a retractable slider actuated by an electromagnet. When the electromagnet is not excited and the cabin is on the floor, the slider engages the lever of the bolt, unlocking the floor door. The movement of the slider is caused by two short rods that substantially form a parallelogram-shaped articulation.

A drawback of known retractable slider systems is represented by the encumbrance which is not negligible. The slider projects by a considerable amount with respect to the section of the cabin. It should be clear that the bulk is a crucial characteristic since the space in the well is limited. Increasing the outer bulk means decreasing the useful volume of the cabin. Moreover, known systems are not economically suitable for lifts in which the doors of the various floors open in different directions with respect to the well and/or the doors are hinged on the right or on the left.

SUMMARY OF THE INVENTION

The purpose of the invention is to overcome the limits of the prior art, by providing an improved system for disengaging the safety lock of floor doors.

The purpose is achieved with a control system for disengaging a safety lock of a lift floor door, said safety lock being provided to prevent the door from opening when the lift cabin is absent, said control being characterised in that it comprises: a linear actuation unit; at least one plate made from elastically deformable material; at least one actuation cable between said actuation unit and said plate; said actuation unit, plate and actuation cable being associated with the lift cabin, in which the actuation cable can induce a deformed configuration of said plate, and said plate is positioned so that: when the cabin is present, the plate in deformed configuration disengages said safety lock so as to allow the floor door to open.

The use of an elastically deformable plate makes it possible to considerably reduce the bulk of the control, and to facilitate its assembly as shall become clearer in the rest of the description. Preferably said plate has a flat shape and is substantially an elongated rectangle, but it should be understood that other shapes are possible. Said plate can be made for example from metal, preferably spring steel, or from plastic material that is sufficiently elastically deformable.

In equivalent embodiments of the invention:

i) the plate in resting conditions is substantially flat and bending of the plate, due to traction of the actuation cable, causes the disengagement of the lock, or vice versa, ii) the plate in resting conditions is curved, preferably in the central part, and its flattening, again due to traction of the actuation cable, causes the disengagement of the lock.

Advantageously, the plate comprises a fixed end firmly attached to a fixed support, and an opposite end that is firmly attached to a mobile support, which can slide linearly in a direction parallel to said plate. Said mobile support constitutes a slide-type constraint. The respective actuation cable is connected to the mobile support. Due to the movement of said mobile support, the deformable plate undergoes a curving or respectively flattens since the end of the plate fixed to the mobile support comes closer or moves away with respect to the other end of the plate which is attached to the fixed support. The changing of configuration of the plate from non deformed to deformed respectively from flat to curved or vice versa, removes the mechanical lock of the floor door.

In a preferred embodiment, the cabin comprises a linear or rotary motor. Said motor is connected by means of a cable or cord, preferably protected by a sheath, to said mobile support or slide.

In a further aspect of the invention, the control comprises a plurality of plates, each plate being connected to the actuation unit with a respective actuation cable, the plates being arranged on different sides of the cabin, so as to allow floor doors, hinged on the right or on the left and positioned on different sides of the well, to open.

The invention can be applied in particular in lifts with manual or semi-manual control of the floor doors. One aspect of the invention is represented by a lift comprising a control for disengaging a safety lock of the floor doors as described.

One advantage of the invention is given by the constructive simplicity and by the small bulk. In particular, the plate has a small projection with respect to the frame of the cabin. Moreover, the number of moving parts is small and it is not necessary to constrain a slider to an articulated system, like in the prior art. Another advantage consists in the possibility of managing lifts with floor doors arranged on different sides with respect to the well and hinged on the right or on the left. Another advantage of the invention is the reliability that is a consequence of the constructive simplicity.

These and other advantages of the invention shall become clearer in the rest of the description, with the help of the description of some preferred but non limiting embodiments, and with the help of the drawings in which:

FIG. 1 schematically shows some components of a control for a floor door, according to one embodiment and showing the unlocking control positioned as if the cabin were on the floor;

DETAILED DESCRIPTION OF PREFERRED EMBODIMENTS

Figure 1:
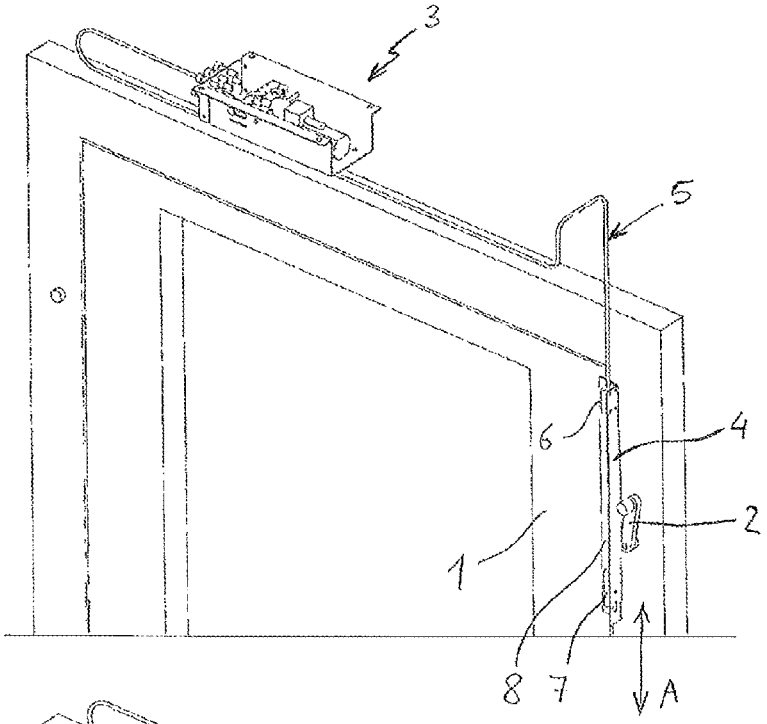
Figure 2:
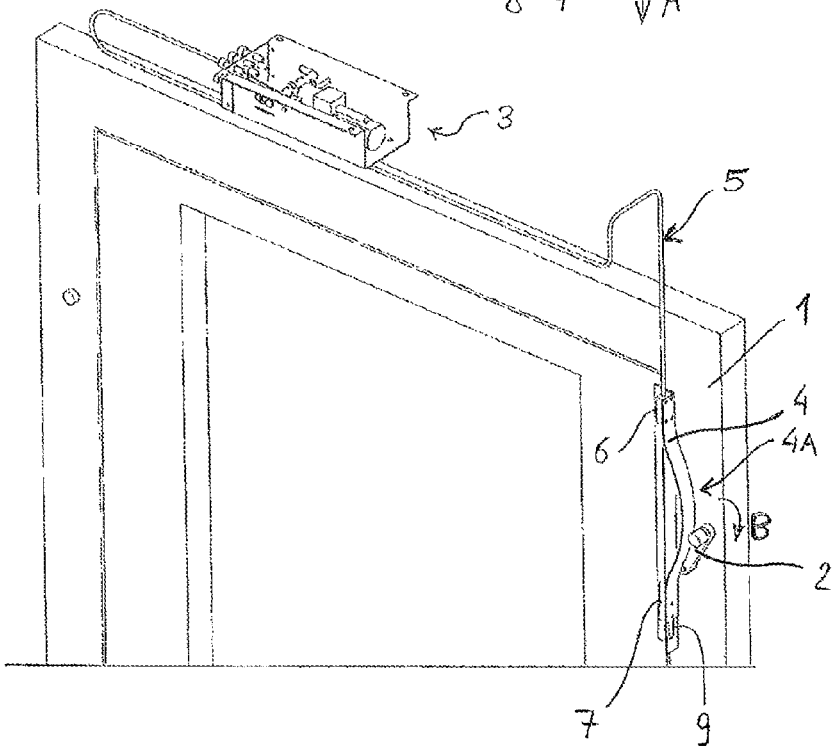
FIG. 2 is analogous to FIG. 1, and shows the control in the position with the door unlocked.

FIGS. 1-2 show the essential components of a control according to an embodiment of the invention. Reference numeral 1 indicates the frame of a lift floor door. Said door has a safety lock system, which prevents it from opening, controlled by a lever 2. The cabin comprises a control for disengaging the aforementioned lock and allowing the floor door to open. Said control essentially comprises a linear actuation unit 3 connected to a plate 4 made of elastically deformable material, for example spring steel, in contact with said lever 2.

The unit 3 acts upon the plate 4 by means of an actuation cable 5, which shall be illustrated in the rest of the description. The ends of the plate 4 are fixed respectively to a first fixed support 6 and to a second mobile support represented by a slide 7. Said slide 7 can slide in the direction indicated by the double arrow A of FIG. 1, parallel to the main dimension (length) of the plate 4.

FIG. 2 shows the deformed configuration of the plate 4, by effect of the traction of the actuation cable 5. It can be seen in the figure how the slide 7 moves, while the opposite support 6 stays still, and consequently how there is a curving $\mathbf{4}_A$ of the plate 4. Due to this deformation, the plate 4 acts upon the lever 2, in particular the curving $\mathbf{4}_A$ causes a rotation of the lever in the direction indicated with B (FIG. 2). Such a rotation B of the lever 2 disengages the safety lock and allows the floor door to open when the cabin is present.

It should be noted that a substantially reversed embodiment is also possible in which the plate in resting condition is curved (FIG. 2) and a traction of the actuation cable 5 has the effect of flattening the plate 4, bringing it into the configuration of FIG. 1, thus freeing the mechanical lock. In such a case the support 6 will be mobile and the support 7 will be fixed. The main advantage of this variant consists of keeping the plate curved even when the respective switch has not been actuated.

Figure 3:
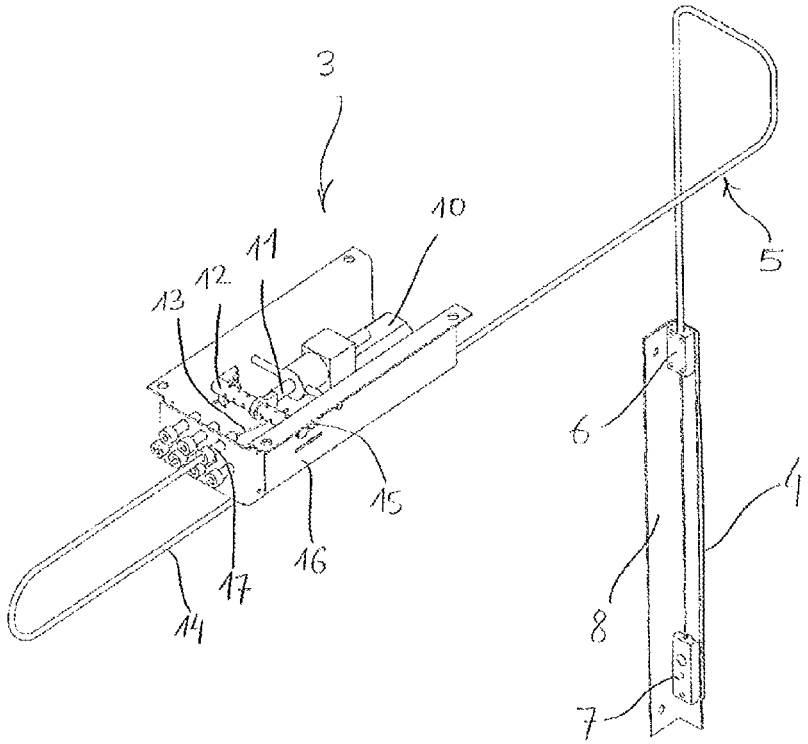
FIGS. 3 and 4 show the main components of the system in greater detail, respectively in locked and unlocked door conditions, according to one embodiment.
Figure 4:
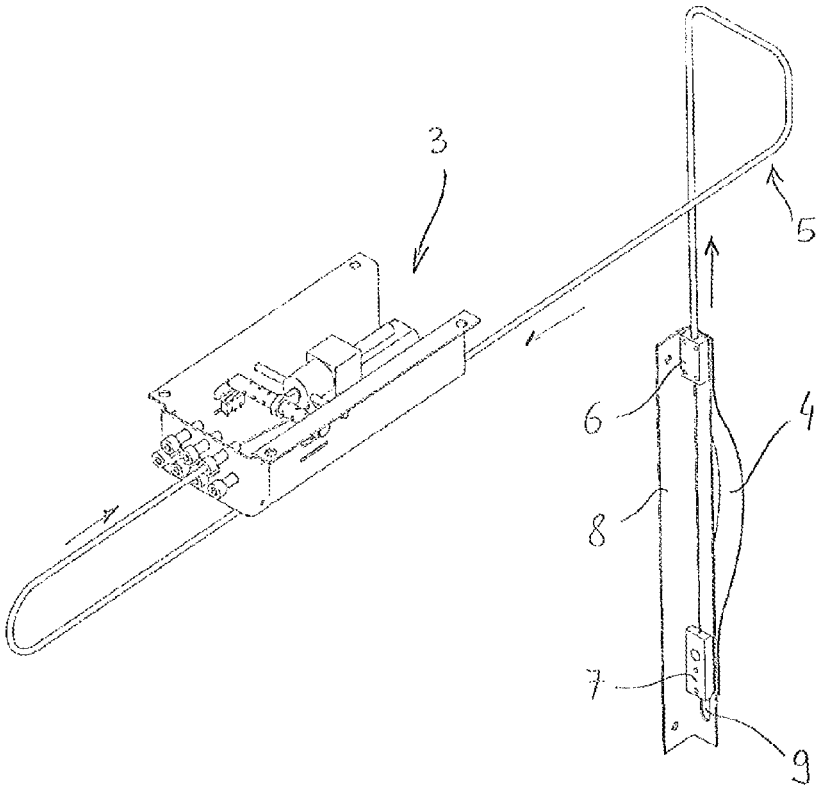

Details of the actuator unit 3, according to a preferred embodiment, are shown in FIGS. 3 and 4. The actuator unit 3 comprises a motor 10 housed in a container 16 fixed to the lift cabin, for example on the roof of the cabin. Said motor 10 linearly actuates a pin 11 with an eyelet that moves forward or backward a cylinder 12, guided by slots 15 of the side walls of the container 16. A first end of a metal cable or cord 13 is fixed to said cylinder 12; the opposite end of the cable 13 is fixed to the slide 7. Said slide 7 slides in a slot 9 of the support 8 which is visible in FIGS. 2 and 4. The cable 13 is covered by a sheath 14 and comes out from a guide pin 17.

Figure 5:
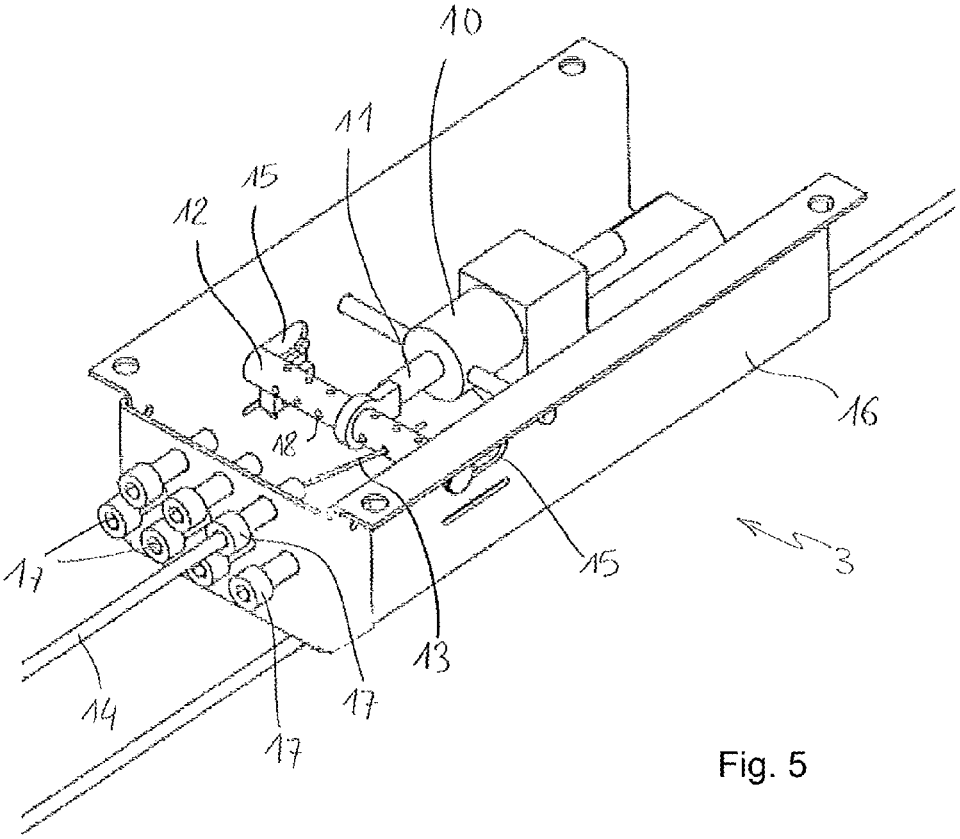
FIG. 5 is a detail of the linear motor unit.

As more clearly visible in the detail of FIG. 5, the unit 3 is foreseen to simultaneously control a plurality of cables 13, having a plurality of holes 18 on the cylinder 12, and a plurality of guide pins 17. This characteristic of the invention makes it possible to simultaneously control a plurality of plates 4 arranged on different sides of the cabin, and is useful in systems where the opening of the doors, on the various floors, is located on different sides of the well and/or is hinged on the right or on the left. Such a characteristic, which forms one of the advantages of the invention, is simplified in FIGS. 6 to 8.

Figure 6:
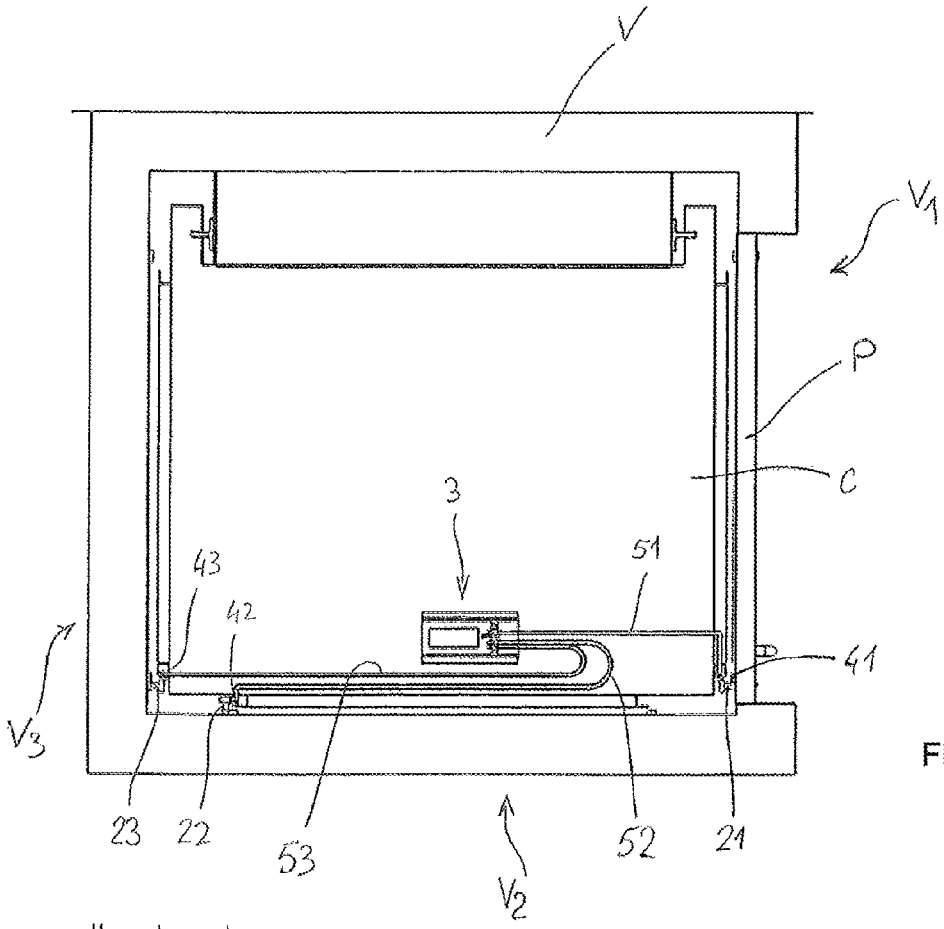
FIG. 6 is a schematic cross section of a lift comprising a system according to the invention, so as to allow the opening of floor doors on different sides of the well hinged on the right or on the left according to the requirements.
Figure 7:
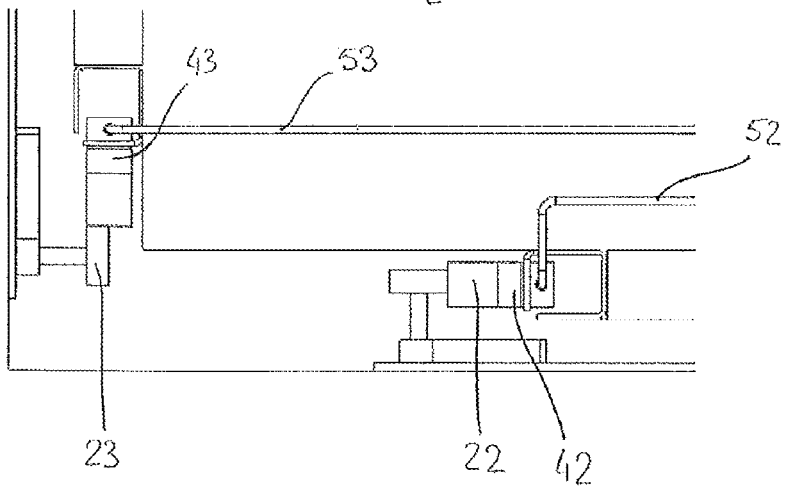
FIG. 7 is a detail of FIG. 6.

In the example of FIG. 6, an actuation unit 3, preferably fixed on the roof of the cabin C, is connected to three actuation cables 51, 52, 53, which act upon respective door locking/unlocking levers 21, 22 and 23 through respective deformable plates 41-43 analogous to the plate 4. Two of these plates 42, 43 are shown in the detail of FIG. 7.

FIG. 6 illustrates a well V, in section corresponding to a certain floor in which the floor door P is present on the side $V_1$ of the well V. The lever 21 consequently unlocks the floor door P; however, the system, also comprising the controls 52, 53 for the levers 22, 23, is capable of also unlocking a floor door present on the lateral side $V_2$ or $V_3$ opposite the side V1.

When the cabin C reaches a certain floor, the actuation unit 3 simultaneously causes the deformation (for example the curving as shown in FIG. 4) of all the plates 41, 42, 43; according to the floor only one of the plates will meet the locking lever 21, 22 or 23, and will unlock the respective door. For example in FIG. 6 it is clear that the plates 42 and 43 deform "idly", whereas the plate 41 meets the lever 21 of the door P unlocking the safety lock and allowing it to open.

Figure 8:
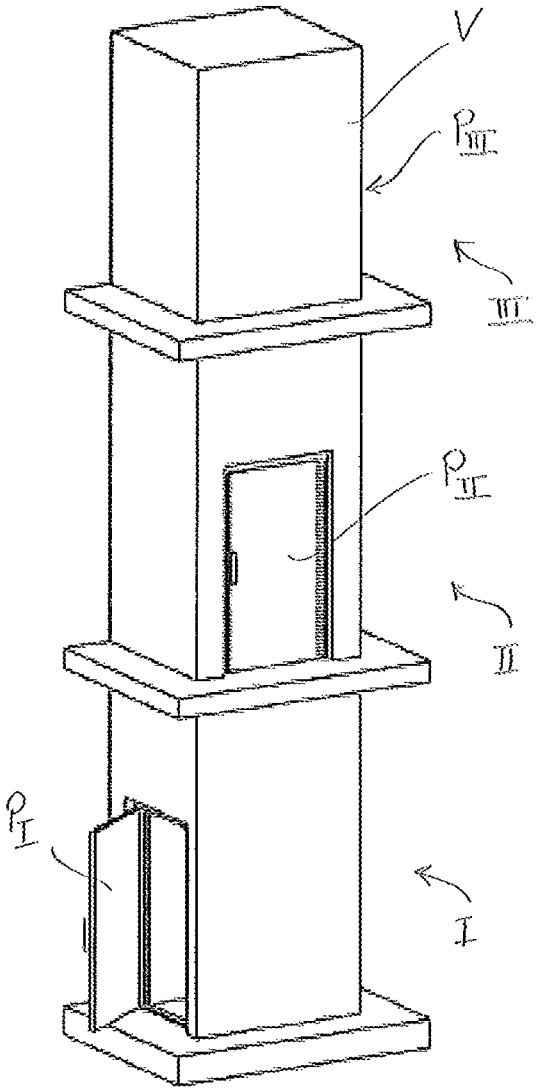
FIG. 8 shows a diagram of a lift with door openings on different sides of the well, and hinged on the right or on the left.

This characteristic is particularly useful in lifts of the type given as an example in FIG. 8, in which on the respective floors I, II and III there are floor doors $P_I$, $P_{II}$ and $P_{III}$ on different sides of the well V and that are hinged on the right or on the left. FIG. 6 makes it possible to appreciate the very small bulk of the control obtained according to the invention.

Figure 9:
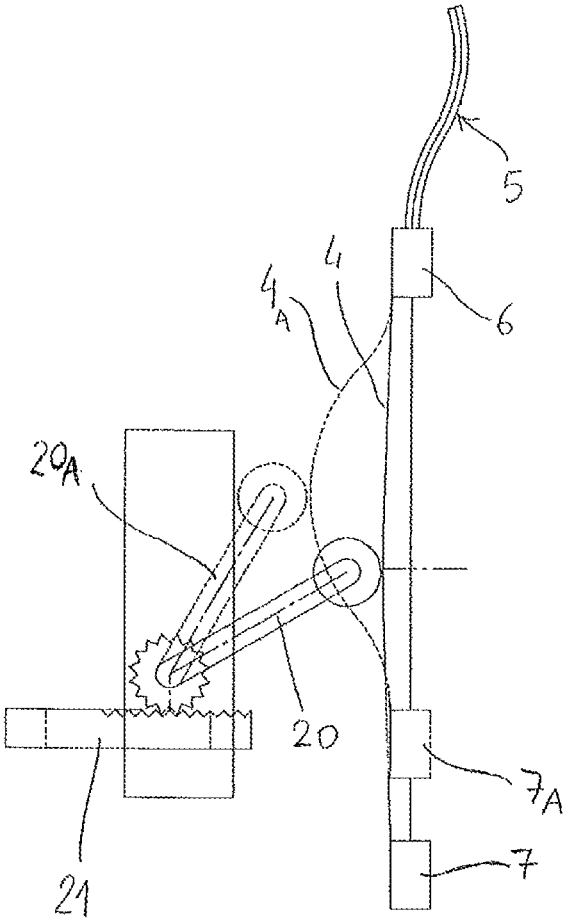
FIG. 9 is a diagram of a floor door mechanical locking and unlocking system, which can be used in some embodiments of the present invention.

With reference now to FIG. 9, in a preferred embodiment, the plate 4 disengages the mechanical lock of the floor door by moving a roller lever 20 that moves a bolt 21. These details, like the lever 20 and the bolt 21, can be made like in the prior art. Due to traction of the actuation cable 5, the slide 7, the plate 4 and the lever 20 are respectively brought into the positions indicated with reference numerals $\mathbf{7}_A$, $\mathbf{4}_A$ and $\mathbf{20}_A$, disengaging the bolt 21. It should be noted that the choice of the system for locking and unlocking the floor door (mechanical bolt or other) is not essential for the purposes of the invention and can be made based upon a technique known in the field.

One example of operation is as follows. The cabin stops at the floor thanks to magnetic sensors positioned on every floor, which give the information of the position of the cabin to the card for controlling the lift. The card controls the stopping of the motor of the lift and the unlocking of the lock of the door through the actuation of the slider, thus supplying power to the unit 3.

The system comprises two end stops which limit the maximum stroke of the slider system, i.e. the maximum stroke of the pin 11. When the cabin arrives at the floor the motor 10 is supplied with power until there is the action of an end stop. The intervention of the end stop interrupts the power supply of the motor and the plate stays in the curved position while the lift cabin is at the floor. When the control card receives a call, the motor 10 is supplied with power to bring the slider back in the retracted position until a second end stop intervenes. After the intervention of said second end stop, the feeding of the motor 10 is interrupted and the plate remains undeformed for the entire stroke of the lift.

The invention claimed is:

1. A control system configured to disengage a safety lock of a lift floor door associated with an elevator shaft, said safety lock configured to prevent the lift floor door from opening when the safety lock is engaged, said control system comprising:

at least one plate on a lift cabin, the at least one plate being elastically deformable such that the at least one plate is configured to vary between a formed configuration and a deformed configuration in which a center portion thereof protrudes relative to ends thereof, the at least one plate being positioned on an outer wall of the lift cabin such that, when the lift cabin is present and the at least one plate is in the deformed configuration, the center portion of the at least one plate contacts a lever to disengage the safety lock of the lift floor door;

a linear actuator configured to deform the at least one plate to the deformed configuration by providing a force thereto; and at least one actuation cable connected between said actuator and the at least one plate, the actuation cable configured to transfer the force to the at least one plate.

2. The control system according to claim 1, wherein the at least one plate has a flat shape in the form of a substantially elongated rectangle.

3. The control system according to claim 2, wherein the at least one plate is made from spring steel.

4. The control system according to claim 2, wherein the at least one plate is made from elastically deformable plastic material.

5. The control system according to claim 1, wherein the at least one plate comprises:

a fixed end that is firmly attached to a fixed support, and a mobile end that is firmly attached to a mobile support, the mobile support configured to slide linearly in a direction parallel to the at least one plate, the mobile support being connected to said actuation cable.

6. The control system according to claim 5, wherein the mobile support is configured to cause the at least one plate to vary configurations between the formed configuration and the deformed configuration in response to the linear sliding of mobile support, and the at least one plate is configured to selectively engage and disengage said safety lock based on the configuration of the at least one plate.

7. A lift comprising: the control system according to claim 1; and a lift cabin in an elevator shaft.

8. The control system according to claim 1, wherein the actuator comprises:

a motor housed in a container fixed to the lift cabin; said motor configured to linearly actuate a pin, the pin having an eyelet that pulls a cylinder forwards or backwards;

at least one cable having a first end and a second end, the first end of the at least one cable being fixed to said cylinder and the second end of the cable being fixed to the mobile support of a respective one of the at least one plate.

9. The control system according to claim 1, further comprising:

a plurality of the at least one plate, each of the at least one plate being connected to the actuator with a respective one of the at least one actuation cables, each of the at least one plate being arranged on different sides of the cabin, so as to allow floor doors positioned on different sides of a well to open irrespective an opening direction of the floor doors.

10. The control system of claim 6, wherein the at least one plate is flat when the at least one plate is in the formed configuration and the at least one plate is curved when the at least one plate is in the deformed configuration.

11. The control system of claim 1, wherein the safety lock of the floor door comprises:

a bolt configured to move between a first position that locks the floor door and a second position that unlocks the floor door; and a rolling lever configured to move the bolt between the first position and the second position as the at least one plate varies between the formed configuration and the deformed configuration.

12. A lock controller comprising:

a mobile support configured to slide in a first direction; and at least one deformable plate having a first end connected to the mobile support, the at least one deformable plate configured to vary, in response to the mobile support sliding in the first direction, a shape thereof between a first configuration where the at least one deformable plate is flat and a second configuration where the at least one deformable plate is curved such that the at least one deformable plate selectively applies pressure, via a lever, to a safety lock of a floor door of an elevator shaft based on whether the at least one deformable plate is in the first configuration or the second configuration, the safety lock configured to selectively allow the floor door to open in response to the pressure from the at least one deformable plate.

13. The lock controller of claim 12, wherein the lock controller is positioned on a lift cabin.

14. The lock controller of claim 13, wherein the lock controller further comprises:

a linear actuator configured to apply a force, via an actuation cable, to the at least one deformable plate such that the at least one deformable plate applies the pressure to the safety lock of the floor door, if when the lift cabin is aligned with the floor door.

15. The lock controller of claim 14, further comprising:

a plurality of the at least one deformable plate, each of the plurality of the at least one deformable plate being arranged on a respective side of at least two sides of the lift cabin, the at least two sides of the lift cabin having an opening that is configured to align with an associated floor door, each of the plurality of the at least one deformable plate configured to selectively apply pressure to a safety lock of the associated floor door based on whether an associated one of the plurality of the at least one deformable plate is in the first configuration or the second configuration, the pressure configured to allow the associated floor door to open irrespective of an opening direction of the floor door.

* * * * *